United States Patent [19]

Nakamura

[11] 4,027,116

[45] May 31, 1977

[54] HEADPHONE

[76] Inventor: Komatsu Nakamura, 2-10, Nodera 2-chome, Niiza, Saitama, Japan

[22] Filed: Nov. 4, 1975

[21] Appl. No.: 628,841

[30] Foreign Application Priority Data

Nov. 13, 1974 Japan ..... 49-129995

[52] U.S. Cl. ..... 179/180

[51] Int. Cl.² ..... H04R 1/28

[58] Field of Search ..... 179/180

[56] References Cited

UNITED STATES PATENTS

| | | | |
|---|---|---|---|
| 1,915,358 | 6/1933 | Giles | 179/180 X |
| 2,022,060 | 11/1935 | Swickard | 179/180 X |
| 2,645,301 | 7/1953 | DeVries | 179/180 X |

*Primary Examiner*—William C. Cooper

*Attorney, Agent, or Firm*—Oblon, Fisher, Spivak, McClelland & Maier

[57] ABSTRACT

A headphone supported at the ear position for reproducing sound comprising (a) a frame, (b) a cone membrane, (c) at least one opening provided in the frame to connect the space, defined between the front face of the frame and the rear face of the cone membrane, and the free space at the rear part of the frame, (d) a member for applying acoustic resistance to sound which passes through the openings, and (e) a mask member to vary bass reproduction characteristics by varying the area of the opening providing the acoustic resistance.

4 Claims, 7 Drawing Figures

HEADPHONE

BACKGROUND OF THE INVENTION

1. Field of the Invention

The present invention relates to a headphone, and more particularly to a headphone speaker wherein low frequency sound reproducing characteristics are made adjustable.

2. Description of the Prior Art

In the conventional speakers such as for headphones, the bass control is accomplished by inserting a high-pass filter consisting of a resistor and a capacitor in parallel with the voice coil of the speaker and thus making the resistor variable. With this method attenuation of the high frequency sound may be adjusted, so that the low frequency sound is relatively emphasized. By this adjustment method, sound tone may be varied and users are satisfied to a certain extent. Since however the reproduction of high frequency is unnecessarily sacrificed, in most cases users hear an unnatural sound. Also, since a variable resistor is used in each speaker, when the speakers are used in a headphone, balanced adjustment between right and left ears is almost impossible, due to the difference in characteristics of the variable resistors.

BRIEF SUMMARY OF THE INVENTION

The object of the present invention is therefore to provide a headphone wherein sound tone adjustment may be made in a completely different manner than any conventional methods. In order to achieve the above object, the headphone according to the present invention including the speaker has at least one opening in the frame supporting the cone or diaphragm of the speaker, so that the sound tone of the speaker may be adjusted by adjusting the area of the opening. With this construction, the sound tone of the speaker is acoustically adjusted, wherein the low-frequency reproduction may be adjusted without sacrificing the reproduction of high frequency, thus providing natural reproduction. Since the adjustment of the area of the opening may be made mechanically the construction itself is simple.

BRIEF DESCRIPTIONS OF THE DRAWINGS

Other objects and advantageous features of the present invention will be apparent from the following description of the invention being made with reference to the accompanying drawings. In the drawings.

DESCRIPTION OF THE PREFERRED EMBODIMENT

Figure 1:
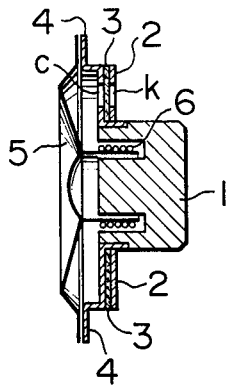
FIG. 1 shows a cross-section of the embodiment of the speaker part of the headphone according to the present invention.
Figure 2:
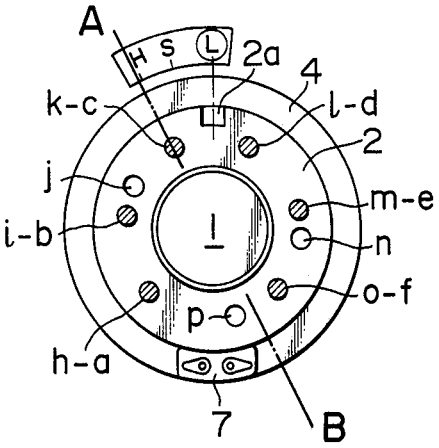
FIG. 2 shows a rear view of the speaker.
Figure 3:
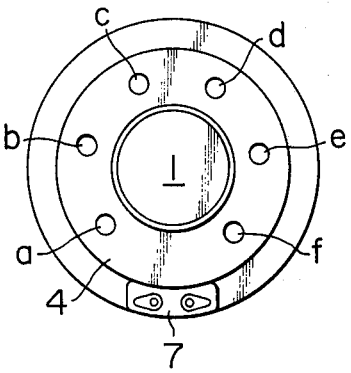
FIG. 3 shows a rear view of the speaker, while a mask and an acoustic resistor being removed therefrom.

As shown in FIG. 1, to a pot core type magnet 1 is fixed a frame 4, at a front outer periphery of which is further fixed the outer periphery of a cone or diaphragm 5. Voice coil 6 is integrally mounted with the cone or diaphragm 5 and moves forwardly and rearwardly with the cone or diaphragm 5 according to current flowing through the coil 6. At the outer periphery of the rear side of the frame 4 is provided a terminal plate 7 for leads to the coil 6 (FIG. 2). In the frame 4 are provided as best shown in FIG. 3 openings *a, b, c, d, e* and *f*. To the rear side of the frame 4 is further attached an acoustic resistor 3 of doughnut shape, made of for example a thin felt. Over the acoustic resistor 3 is mounted an acoustically rigid mask 2, which is rotatable around the magnet 1. At the outer periphery of the mask 2 is provided a notched portion 2*a* with which an engaging member, not shown, is used to rotate the mask angularly. To the mask 2 are further provided openings *h, i, j, k, l, m, n, o* and *p*. The relation between these openings *h* through *p* and the openings *a, b, c, d, e* and *f* in the frame 4 is as follows: When the notched portion 2*a* in the mask 2 is positioned at the L position, the respective centers of openings *h* and *a; i* and *b; k* and *c; l* and *d; m* and *e;* and *o* and *f* coincide. The coincident openings are shown in FIG. 2 with slanting lines.

Figure 4:
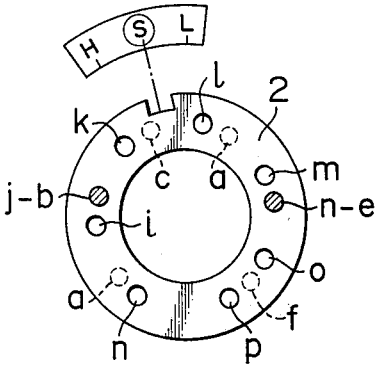
FIGS. 4 and 5 are views for explaining the relation of position of the openings provided in the mask and the speaker frame.

When the notch 2*a* of the mask 2 is at the position of S, the openings of *j* and *b;* and *n* and *e* are coincident as shown in FIG. 4.

Figure 5:
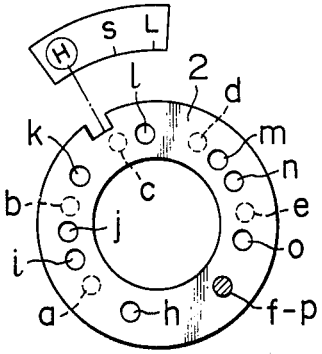

When the notched portion 2*a* of the mask 2 is at the position of H, the pair of openings *f* and *p* coincide, as shown in FIG. 5 with slanting lines.

Figure 6:
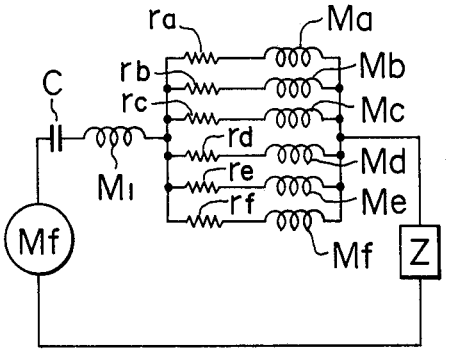
FIG. 6 is an equivalent circuit for explaining sound reproducing characteristics.

In FIG. 6, M*f* denotes the equivalent EMF the mechanical generator and, voice coil, and Z is a radiation impedance. C is the acoustic capacitance of the suspension system. $M_1$ is the inductance corresponding to the mass of the cone or diaphragm 5, the mass of the coil and the air in the vicinity of the cone 5. *ra, rb, rc, rd, re* and *rf* are the acoustic resistances of the acoustic resistor 3 and M*a*, M*b*, M*c*, M*d*, M*e* and M*f* are inductances corresponding to the equivalent acoustic mass of the cavity defined between the openings, the cone or diaphragm 5 and the frame 4.

When the mask 2 is at the positions of L, S, H, respectively, the value of *fo* at the respective positions, $fo_L$, $fo_S$, $fo_H$ would be:

$$fo_L = \tfrac{1}{2\pi} \cdot \sqrt{C(M_1+Ma/6)}$$

$$fo_S = \tfrac{1}{2\pi} \cdot \sqrt{C(M_1+Ma/2)}$$

$$fo_H = \tfrac{1}{2\pi} \cdot \sqrt{C(M_1+Ma)}$$

wherein M*b*, M*c*, M*d*, M*e* and M*f* are respectively taken as equal to M*a*. From these equations the following relation is seen: $fo_L > fo_S > fo_H$. Namely, the acoustic resistance of $fo_L$ is the least, i.e. when all *rb, rc, rd, re* and *rf* are respectively equal to *ra*, it is *ra*/6, while the resistance of $fo_S$ and $fo_H$ are *ra*/2 and *ra*, resectively. The Q value is the largest in $fo_L$ and followed by $fo_S$ and $fo_H$ in that order.

Figure 7:
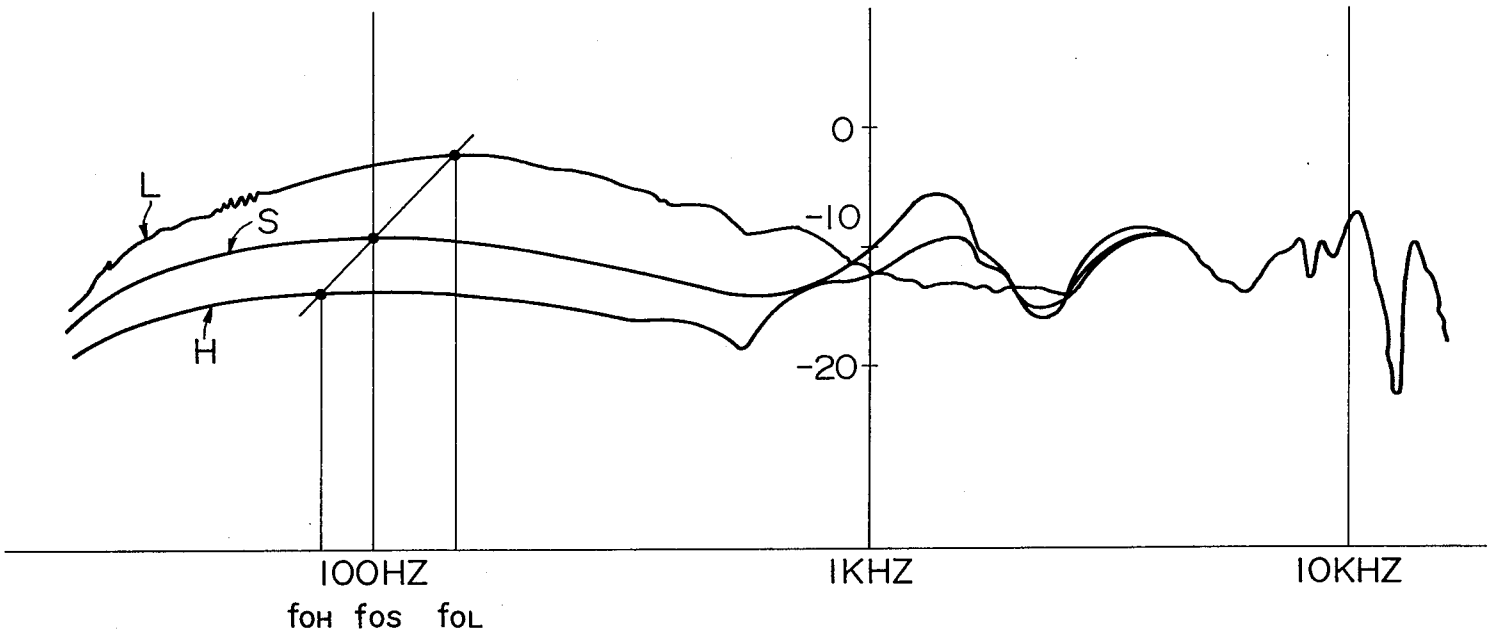
FIG. 7 shows sound reproducing characteristics.

In FIG. 7, the curve L is for the case of six pairs of openings being coincident, the curve S for the case of two openings coincident and the curve H for one pair of openings coincident. As will be seen in these curves, the highest low frequency reproduction is the curve L and followed by S and H in that order, as already expected.

As has been clear from the above description, according to the present invention the tone of the speaker may be adjusted with very simple acoustic construction and accordingly when it is applied to a headphone simple and certain tone adjustment may be made. In this embodiment since the high frequency output is not sacrificed as mentioned before, natural tone control becomes possible.

With reference to the embodiment explained above, modifications and changes are possible to the skill in the art within the scope of the Claims. For example, number and forms of openings may be changed. The scope of the present invention therefore covers not only circle shape openings as shown in the above embodiment, but extends to any non-circular openings, such as rain drop form. As for the number of openings, the same effect may be obtained with a single pair of openings or without any opening in the mask by varying the area of opening(s) lapped by the mask. In short, the invention covers adjustment in all such opening(s) defined between the frame and the mask, unless the opening(s) become(s) extremely small.

What is claimed as new and desired to be secured by Letters Patent of the United States is:

1. A headphone for reproducing sound comprising:
a frame;
a cone membrane supported for vibration at the outer periphery of one side of the frame;
the frame being provided with at least one opening to connect the space defined between the one side of the frame and the cone membrane with free space at the other side of the frame;
a mask member for varying the area of the opening in the frame to vary bass reproduction of sound produced by vibration of the cone membrane; and
an acoustic resistance member disposed across the opening.

2. A headphone according to claim 1, wherein:
the mask member is acoustically rigid and is rotatably supported by the frame.

3. A headphone according to claim 1 wherein:
the acoustic resistance member is mounted substantially parallel to the other side of the frame, and the mask member is rotatable in a plane parallel to the frame.

4. A headphone according to claim 1, wherein:
at least one opening is provided in the mask member concentrically with the opening of the frame and the mask member is rotatable to select effective paths defined between the opening of the frames and the mask member.

* * * * *